US007718885B2

(12) United States Patent
Lindemann

(10) Patent No.: US 7,718,885 B2
(45) Date of Patent: May 18, 2010

(54) EXPRESSIVE MUSIC SYNTHESIZER WITH CONTROL SEQUENCE LOOK AHEAD CAPABILITY

(76) Inventor: Eric Lindemann, 2975 18th St., Boulder, CO (US) 80304

( * ) Notice: Subject to any disclaimer, the term of this patent is extended or adjusted under 35 U.S.C. 154(b) by 353 days.

(21) Appl. No.: 11/633,675

(22) Filed: Dec. 4, 2006

(65) Prior Publication Data

US 2007/0137465 A1 Jun. 21, 2007

Related U.S. Application Data

(60) Provisional application No. 60/742,289, filed on Dec. 5, 2005.

(51) Int. Cl.
*G10H 1/02* (2006.01)
*G10H 1/06* (2006.01)
*G04B 13/00* (2006.01)

(52) U.S. Cl. ..... 84/626; 84/609; 84/622; 84/628

(58) Field of Classification Search ..... 84/609, 84/626, 628, 622
See application file for complete search history.

(56) References Cited

U.S. PATENT DOCUMENTS 4,154,131 A * 5/1979 Studer et al. ..... 84/638
4,365,533 A * 12/1982 Clark et al. ..... 84/682
4,998,960 A * 3/1991 Rose et al. ..... 84/622
5,403,971 A * 4/1995 Aoki ..... 84/626
5,578,780 A * 11/1996 Wachi ..... 84/659
5,687,240 A * 11/1997 Yoshida et al. ..... 381/61
5,734,118 A * 3/1998 Ashour et al. ..... 84/609
5,744,742 A * 4/1998 Lindemann et al. ..... 84/623
5,781,461 A * 7/1998 Jaffe et al. ..... 708/301
5,981,860 A * 11/1999 Isozaki et al. ..... 84/603
6,087,578 A * 7/2000 Kay ..... 84/626
6,111,183 A * 8/2000 Lindemann ..... 84/633
6,298,322 B1 * 10/2001 Lindemann ..... 704/222
6,316,710 B1 * 11/2001 Lindemann ..... 84/609
RE37,654 E * 4/2002 Longo ..... 84/626
6,452,082 B1 * 9/2002 Suzuki et al. ..... 84/609
6,459,028 B2 * 10/2002 Yamauchi ..... 84/477 R
6,816,833 B1 * 11/2004 Iwamoto et al. ..... 704/207
7,259,315 B2 * 8/2007 Tamura et al. ..... 84/627
7,271,331 B2 * 9/2007 Lindemann ..... 84/628
7,319,185 B1 * 1/2008 Wieder ..... 84/609

(Continued)

*Primary Examiner*—Jeffrey Donels
*Assistant Examiner*—Christina Russell
(74) *Attorney, Agent, or Firm*—Jennifer L. Bales; Macheledt Bales LLP

(57) ABSTRACT

The present synthesizer includes functionality for changing over from a current note to the following notes that results in natural and expressive combinations and transitions. The method of the present invention incorporates an delay (actual, functional, or look ahead) between receiving control data inputs and generating an output sound. This period of delay is used to modify how notes will be played according to control data inputs for later notes. The input to the synthesizer is typically a time-varying MIDI stream, which may be provided by a musician or a MIDI sequencer from stored data. An actual delay occurs when the synthesizer receives a MIDI stream and buffers it while looking ahead for changeovers between notes. A functional delay occurs in a system in which the synthesizer has knowledge of note changeovers ahead of time. A look ahead delay occurs when the synthesizer queries the sequencer for information about the stored sequence ahead of when the synthesizer needs to generate the output for the sequence.

18 Claims, 12 Drawing Sheets

U.S. PATENT DOCUMENTS

2003/0164084 A1* 9/2003 Redmann et al. ..... 84/615
2003/0188627 A1* 10/2003 Longo ..... 84/627
2007/0039449 A1* 2/2007 Redmann ..... 84/609
2007/0137466 A1* 6/2007 Lindemann ..... 84/626
2009/0158919 A1* 6/2009 Akazawa ..... 84/622

* cited by examiner

EXPRESSIVE MUSIC SYNTHESIZER WITH CONTROL SEQUENCE LOOK AHEAD CAPABILITY

The following patents and applications are incorporated herein by reference: U.S. Pat. No. 5,744,742, issued Apr. 28, 1998 entitled "Parametric Signal Modeling Musical Synthesizer;" U.S. Pat. No. 6,111,183, issued Aug. 29, 2000 entitled "Audio Signal Synthesis System Based on Probabilistic Estimation of Time-Varying Spectra;" U.S. Pat. No. 6,298,322, issued Oct. 2, 2001 and entitled "Encoding and Synthesis of Tonal Audio Signals Using Dominant Sinusoids and a Vector-Quantized Residual Tonal Signal;" U.S. Pat. No. 6,316,710, issued Nov. 13, 2001 and entitled "Musical Synthesizer Capable of Expressive Phrasing;" and U.S. patent application Ser. No. 11/334,014, filed Jan. 18, 2006 by the present inventor.

This application claims the benefit of Provisional Application for Patent Ser. No 60/742,289 filed Dec. 5, 2005.

FIELD OF THE INVENTION

This invention relates to a method of synthesizing sound, in particular music, wherein a delay between receiving control signal inputs and generating an output sound signal is incorporated in order to produce a more natural output sound.

BACKGROUND OF THE INVENTION

Music synthesis generally operates by taking a control stream such as MIDI input and generating sound associated with that input. MIDI inputs include the instrument to play, pitch, and loudness. Other MIDI inputs may include MIDI modulation control, and vibrato speed.

Simply generating a signal that has the correct pitch and loudness produces a very poor, synthetic sound. All music needs time varying elements, such vibrato, to sound natural.

In addition, natural music does not switch abruptly between one note and another in a step-wise fashion. Rather, there is a period of transition, starting before the changeover from one note to the next begins and continuing for some time after the changeover ends.

In addition, the contour of a note as it changes over time, and the shape of the transition from one note to the next, is highly dependent on the context of the note within a musical phrase. Just as a skilled reader processes written text as phrases rather than individual words or syllables, a skilled instrumentalist processes groups of notes as musical phrases. The musical phrase forms a single shape or acoustic gesture in the mind of the performer. This shape is translated, almost unconsciously, into detailed physical actions on the instrument. Connecting notes to form phrases is essential to expressive performance.

U.S. Pat. No. 6,316,710 to Lindemann describes a synthesis method which stores segments of recorded sounds, particularly including transitions between musical notes, as well as attack, sustain and release segments. These segments are sequenced and combined to form an output signal. U.S. Pat. No. 6,298,322 to Lindemann describes a synthesis method which uses dominant sinusoids combined with a vector-quantized residual signal. U.S. Pat. No. 6,111,183 to Lindemann describes a synthesizer which models the time varying spectrum of the synthesized signal based on a probabilistic estimation conditioned to time-varying pitch and loudness inputs.

A need remains in the art for improved methods and apparatus for transitioning between successive notes in a natural and expressive manner, and for shaping notes as a function of their context within a musical phrase.

SUMMARY OF THE INVENTION

Accordingly, an object of the present invention is to provide improved methods and apparatus for transitioning between successive notes in a natural and expressive manner, and for shaping notes as a function of their context within a musical phrase. The method of the present invention incorporates a delay (designated actual, functional, or look ahead delay) between receiving control stream inputs and generating an output sound. This period of delay is used to look ahead to the next note or series of notes, to begin the transition to the next note before the changeover occurs, and, in the case where a series of upcoming notes has been identified, to plan the synthesis of the series of notes as a single phrase rather than individual isolated notes, to achieve improved expressivity and naturalness.

The input to the synthesizer is typically a time-varying MIDI stream, comprising at least the desired instrument (if the synthesizer synthesizes more than one instrument), the note (pitch) and loudness.

In one embodiment the control signal stream is generated "live". A musician plays a keyboard or the like which generates a control stream such as a MIDI stream. A small delay between receipt of the MIDI stream and synthesis of the sound is used to begin the next note transition before the note changeover.

In another embodiment the control stream is generated from a control sequence stored in a data file or in computer memory and now output from a sequencer such as a MIDI sequencer to the synthesizer. When the synthesizer receives the control stream it waits an actual delay time before generating the note changeovers associated with the sequence. The delay time can range from a fraction of a second to several seconds but is generally fixed for a given sequence playback. This delay allows the synthesizer to begin generating a transition before a changeover occurs, or to identify a series of upcoming notes and plan the synthesis of the series of notes as a single phrase.

In a third embodiment the control stream is again generated from a control sequence stored in a data file or in computer memory. The sequencer outputs the control stream to the synthesizer a functional delay time in advance of when the synthesizer needs to generate the sound output. The functional delay time serves the same purpose as the actual delay of the previous embodiment: to allow the synthesizer to look ahead to upcoming notes in the control sequence in order to improve expression by adding transitions and the like. The difference for the user with respect to the previous embodiment is that when interacting with the sequencer—e.g. viewing and editing sequences on a computer screen, listening to playback of sequences, etc—the user does not perceive any delay. The delay is hidden by the internal action of the sequencer in delivering the stored sequence to the synthesizer ahead of time. The sequencer may deliver one or more upcoming notes to the synthesizer in advance of when the synthesizer needs to generate the output. In a limiting case the sequencer may deliver the entire sequence to the synthesizer before the synthesizer synthesizes even the first note. In the latter case the sequencer plays little or no role in controlling the synthesizer while the synthesizer is actually generating synthesized output based on the previously delivered sequence. In a variation of the latter case the synthesizer loads the sequence directly from a file such as a MIDI file since the sequencer is playing no event scheduling role during synthesis. When we discuss "functional delay" it is always understood to comprise any of the above variations ranging from delivering one note in advance to delivering or loading the entire sequence in advance of synthesizing output.

In a fourth embodiment the control stream is again generated from a control sequence stored in a data file or in computer memory and now output from a sequencer such as a MIDI sequencer to the synthesizer. The synthesizer queries the sequencer for information about the stored sequence ahead of when the synthesizer needs to generate output for the sequence. The query ahead or look ahead approach is functionally equivalent to the sequencer providing the sequence ahead of time as described in the previous embodiment. Similar to the previous embodiment, the synthesizer may request one or more upcoming notes from the sequencer. In a limiting case the synthesizer may request the entire sequence in advance of synthesizing the even first note. When we discuss the synthesizer querying for notes in advance of synthesis it is always understood to comprise any of the above variations ranging from requesting one note in advance to requesting or loading the entire sequence in advance of synthesizing output.

The term "delay" is understood herein to encompass any sort of delay inserted by the system in order to examine control signals relating to upcoming notes, such as actual delay, functional delay, or look ahead delay.

Traditional sampling synthesizers use a collection of recordings (a sample library) of individual notes recorded at various pitches and intensities from a variety of instruments. When a note command such as a MIDI note-on is received by the sampling synthesizer one of these note recordings is played out. In one embodiment, described in U.S. Pat. No. 6,316,710 to Lindemann, an extension to traditional sampling synthesis is described in which the recordings include transitions between musical notes and may also include recordings of sequences of several notes that form all or part of a musical phrase.

A recording of a single note transition such as a slur corresponds to the ending of a first note, followed by a transition period, followed by the beginning of the next note. In order for recordings of note transitions to be used effectively, at some time during the sustain of the first note a determination must be made that a slur to a second note is desired. Then the appropriate transition recording must be found and a splice must be made from the first note sustain to the transition recording. This splice will occur before the second note begins, since the transition recording includes the end of the first note and the beginning of the second note.

In a fifth embodiment of the present invention, any of the first four embodiments are used to provide information including the start time, pitch, and intensity of the second note during the sustain of the first note. Due to the delay inserted by the present invention, this information is provided sufficiently in advance of the start of the second note so that the splice to the transition recording (called a note transition waveform) that includes an ending period of the first note can occur.

In a sixth embodiment of the present invention, any of the first four embodiments are used to provide information including the start time, pitch, and intensity of one or more upcoming notes of the current musical sequencer. Due to the delay (functional, actual, or look ahead) of the present invention, this information is provided sufficiently in advance that a single recording of several connected notes can be found and modified to form the synthesized output corresponding to the next several notes of the input MIDI sequencer.

In the case of traditional samples, note transitions and series of notes are not included in the sample library, only individual note recordings (called individual note waveforms). Nevertheless, some of the effect of a realistic note transition, such as a slur, or a realistic sequence of notes can be achieved by applying time-varying control envelopes (or waveform envelopes) such as amplitude envelopes to the ending period of the notes in a series in preparation for the following note. These waveform envelopes may continue through the transition periods between notes into the beginning part of the following note.

In a seventh embodiment of the present invention, any of the first four embodiments is used to provide information including the start time, pitch, and intensity of the second note during the sustain of the first note. Due to the delay inserted by the present invention, this information is provided sufficiently in advance of the start of the second note so that one or more appropriate time-varying envelopes can be applied beginning before the ending of the first note. These envelopes help to provide a realistic sounding transition between the individual note records associated with the first and second note.

In an eighth embodiment of the present invention, any of the first four embodiments are used to provide information including the start time, pitch, and intensity of one or more upcoming notes of the current musical sequencer. Due to the delay of the present invention, this information is provided sufficiently in advance that one or more appropriate time-varying envelopes can be applied. These envelopes help to provide realistic sounding transitions between the individual note records.

U.S. Pat. No. 6,111,183, issued Aug. 29, 2000 entitled "Audio Signal Synthesis System Based on Probabilistic Estimation of Time-Varying Spectra" and U.S. Pat. No. 6,298,322, issued Oct. 2, 2001 and entitled "Encoding and Synthesis of Tonal Audio Signals Using Dominant Sinusoids and a Vector-Quantized Residual Tonal Signal" both to Lindemann describe techniques for storing and synthesizing sounds in terms of time-varying amplitude and pitch envelopes of sinusoidal sound components or harmonics.

In a ninth embodiment of the present invention splicing is implemented in a manner similar to that described in embodiment five, however, in this case the splicing occurs between note transition parameters of a parametric synthesizer rather than a time-domain waveform as in the fifth embodiment.

In a tenth embodiment of the present invention the parameters of a parametric synthesizer comprise individual note parameters, which are artificially altered during the ending period of the first note in preparation for the second note, emulating a note transition slur. The alterations are accomplished using parameter envelopes which may include (but are not limited to) increasing or decreasing the amplitude of selected note parameters in preparation for a second note, with the effect of increasing the realism of the transition between notes. This technique may also be applied to modifying transitions between a series of notes in a phrase.

DETAILED DESCRIPTION OF THE INVENTION

Figure 1:
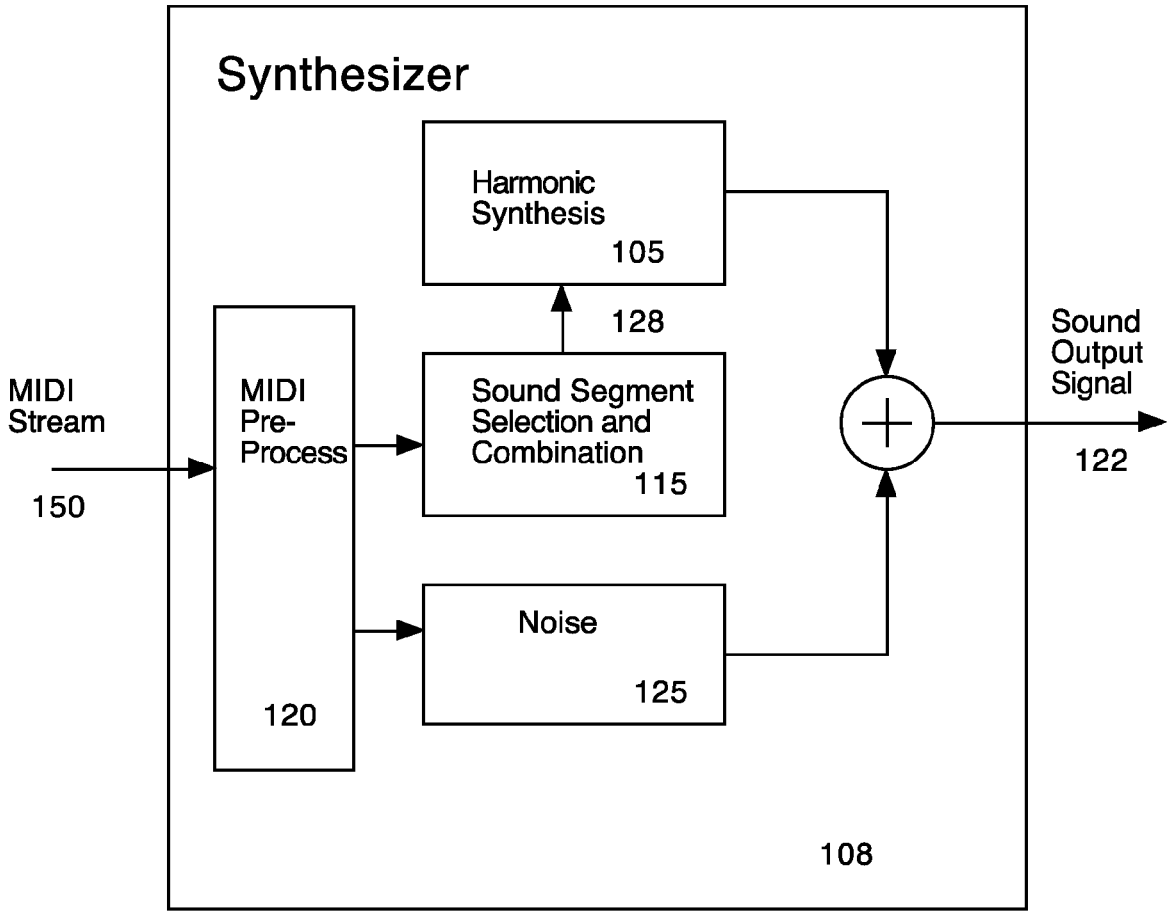
FIG. 1 is a block diagram showing an example sound synthesizing system.

FIG. 1 is a block diagram showing an example sound synthesizing system 108. The present invention incorporates a delay between receiving control data inputs and generating an output sound, and uses this period of delay to look ahead to the note changeover and begin the transition before the changeover occurs. The present invention can be used in a variety of different sound synthesizing systems including but not limited to traditional sampling synthesizers, FM synthesizers, physical modeling synthesizers, and additive synthesizers but the synthesizer 108 illustrated in FIG. 1 works well.

Synthesizer 108 utilizes an input data stream 150 (most commonly MIDI) to generated an output sound signal 122. A MIDI pre-processor 120 decodes MIDI 150 and generates a variety of data and control signals used by the rest of synthesizer 108 (see FIGS. 3 and 4 for more detail). A harmonic synthesizer 105 utilizes time varying pitch and generates an output representing the tonal audio portion of the output sound 122. Harmonic synthesis is a well-known process in the field of music synthesis and is not described here in detail. One example of a method for harmonic synthesis is described in Provisional Application for Patent Ser. No. 60/644,598, filed Jan. 18, 2005 by the present inventor, and incorporated herein by reference.

A noise block 125 may be used to mix noise elements into the output sound signal 122, but is optional. Many synthesizers do not use noise elements at all.

Figure 2A:
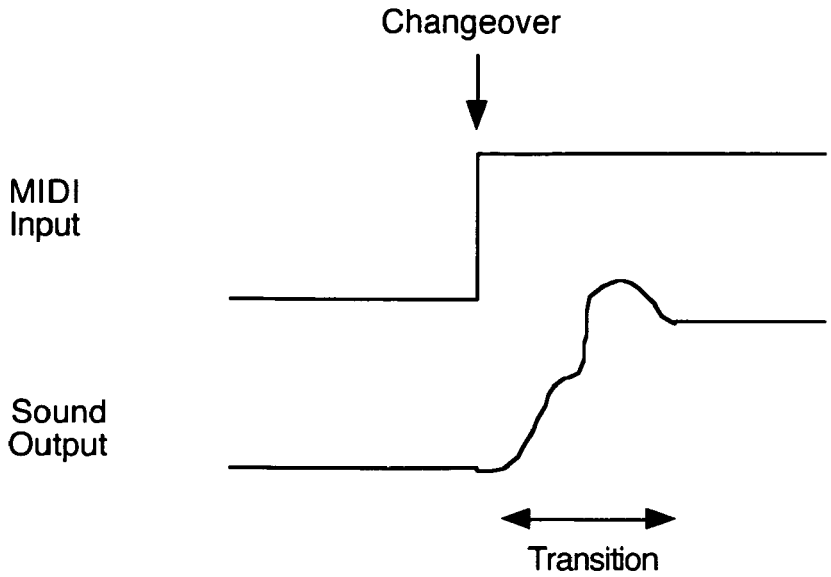
Figure 2A (Prior Art)
FIG. 2A (Prior Art) is a flow diagram illustrating how transitions between notes have been generated conventionally.

FIG. 2A (Prior Art) is a flow diagram illustrating how transitions between notes have been generated conventionally. Since conventional synthesizers only have knowledge that the changeover from one note to another is going to happen once it actually occurs, the transition phase in the output signal between one note and the next starts at the changeover point. Traditional synthesizers often deal with this limitation by reducing or eliminating the part of the note transition that occurs prior to the changeover point. This type of transition does not sound realistic, as real life transitions begin before the changeover point.

Figure 2B:
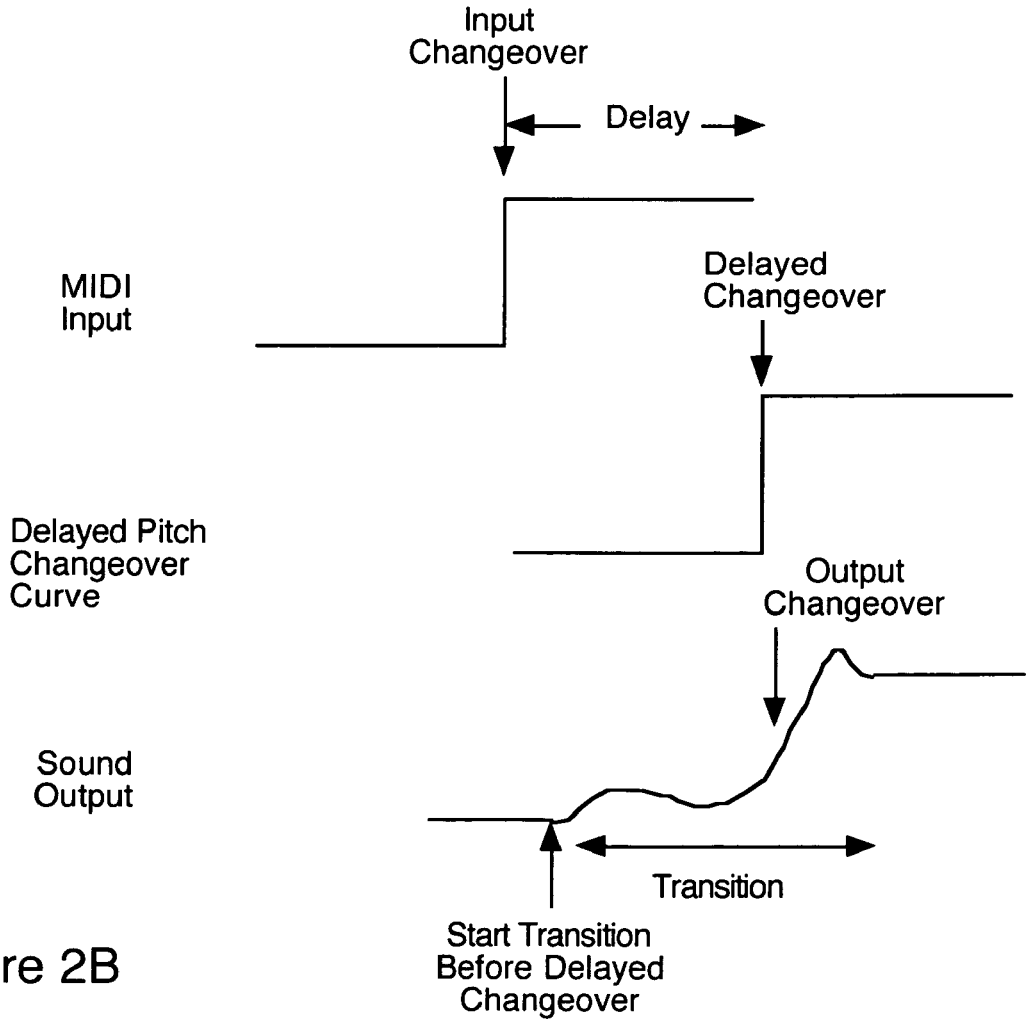
FIG. 2B is a flow diagram illustrating how transitions between notes are generated according to the present invention.

FIG. 2B is a flow diagram illustrating how transitions between notes are generated according to the present invention. A delay period is used to look ahead and determine that a note changeover is coming. Then, in the output signal, the transition is generated between the notes, starting before the changeover point.

The difference between an actual delay and a functional delay is described below, and shown in more detail in FIGS. 5-7. Briefly, an actual delay occurs when a sequencer outputs a control sequence to the synthesizer in the normal fashion. The synthesizer receives a control sequence stream and buffers it while looking ahead for changeovers between notes. Then the synthesizer knows when changeovers will happen and begins note transitions before the actual changeover point. With the actual delay, the sound output occurs a delay time after the synthesizer receives the control stream so the sound appears to the user to be delayed relative to the actions of the sequencer. For example there may be a blinking cursor associated with the sequencer which progresses across the screen in real time showing the current location of the sequencer. With the actual delay the sound output is delayed with respect to this cursor. A functional delay occurs in a system in which the sequencer outputs the control sequence to the synthesizer ahead of time so that the sound output is now synchronized with the sequencer's blinking cursor.

Figure 3:
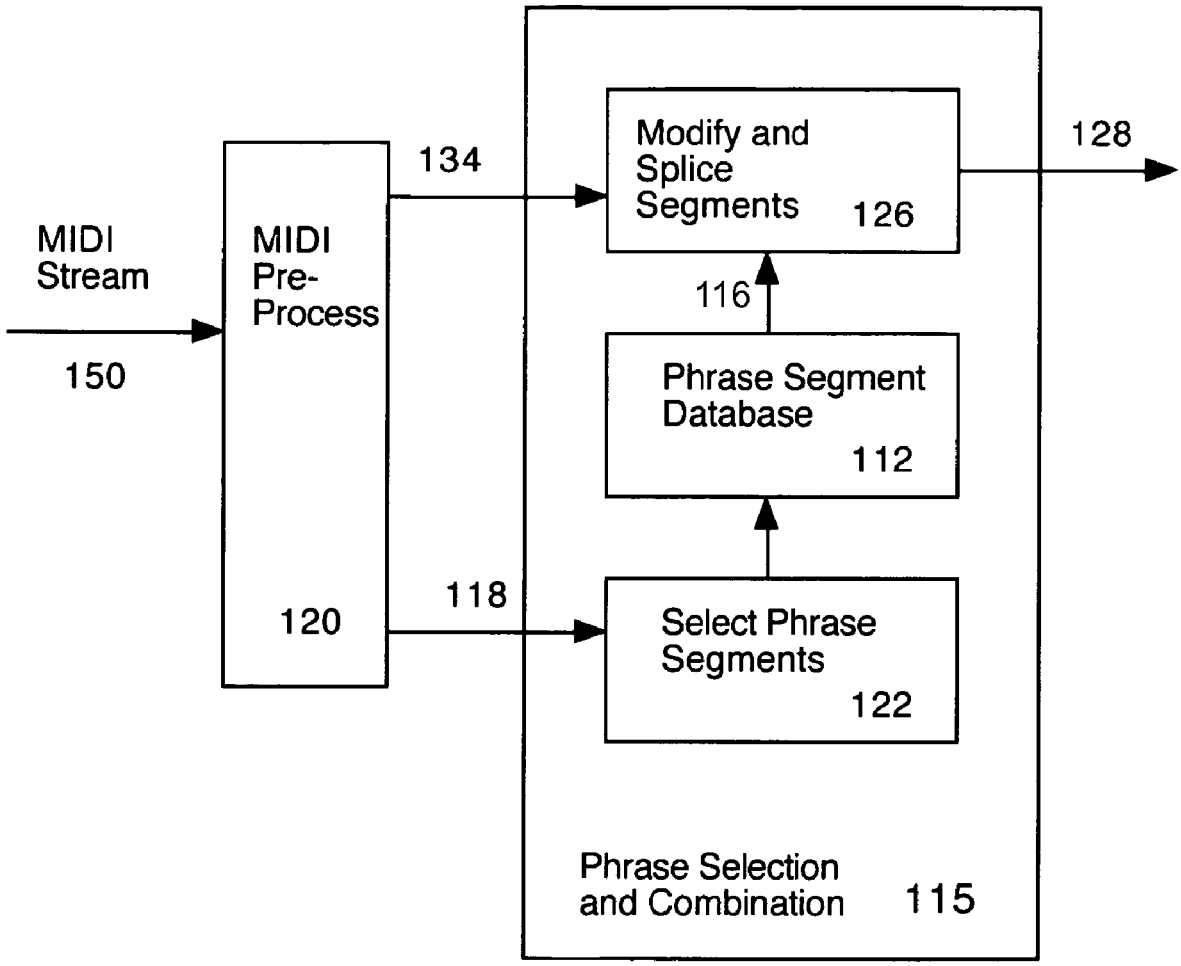
FIG. 3 is a block diagram illustrating the phrase selection and combination component of the synthesizer of FIG. 1 in more detail.

FIG. 3 is a block diagram illustrating the phrase selection and combination component 115 of synthesizer 108 in more detail. U.S. Pat. No. 6,316,710, issued Nov. 13, 2001 and entitled "Musical Synthesizer Capable of Expressive Phrasing," describes a method of phrase selection and combination in great detail, and is incorporated herein by reference. This 128 of FIG. 1 portion of output sound 122 of FIG. 1 is generated by selecting and combining spectral fluctuation segments stored in a database 112. The stored segments were previously derived from analysis of recorded notes and phrases. Signal 118 (detailed in FIG. 4) is used to select particular phrase segments 116. Phrase segments 116 are spliced by block 126. Block 126 also modifies segments 116 (for example, by stretching or pitch shifting them) according to control signal 134, better shown in FIG. 4.

Figure 4:
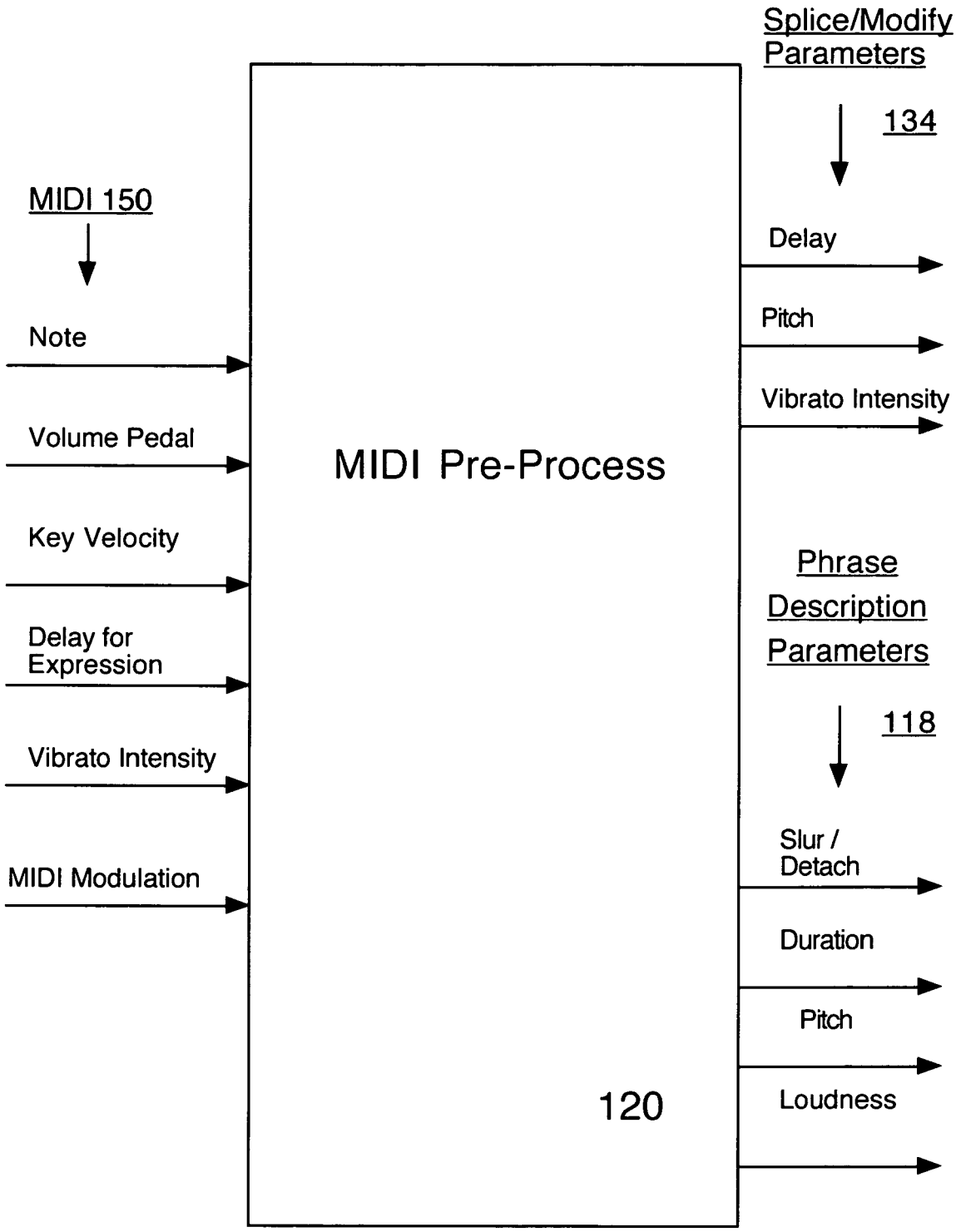
FIG. 4 is a flow diagram showing how the MIDI input signal is processed for use by the synthesizer.

FIG. 4 is a flow diagram showing how the MIDI input signal is processed for use by the synthesizer. MIDI pre-process block 120 is an example showing the kind of input MIDI signals which can be useful as inputs to a synthesizer 108, and the kind of signals which my be generated for use within synthesizer 108. Pre-process block 120 may be either more or less complicated, depending upon the requirements and capacities of the synthesizer processing and data storage. In the present invention, the MIDI pre-process block 120 of FIG. 3 includes the input "delay for expression" to allow more complex combination and modification of segments from database 112 because of the delay period used by synthesizer 108. Because of the delay for expression, the Modify and Splice Segments block 126 knows when a changeover will occur, and hence can splice in a transition segment starting before the changeover point. Several output signals shown in FIG. 4 (such as note duration and real time or delay) are generated by MIDI pre-process block 120 because of the delay period.

In the example of FIG. 4, the MIDI inputs 150 comprise several time-varying signals: note (pitch), volume pedal, key velocity, delay for expression, vibrato intensity, and MIDI modulation. These are standard MIDI inputs and are discussed in detail in various places. For example, see U.S. Pat. No. 6,316,710, especially the text associated with FIG. 3, describing the input musical control sequence $C_{in}(t)$.

Phrase description parameters 118 are the inputs to Select Phrase Segments block 122, and include such signals as note slur/detach, note duration, and pitch and loudness. "Note duration" is used by Select block 122 in selecting appropriate transition segments from database 112. Slur/detach indicates the amount of slur from the end of one note to the beginning of the next, or the amount of detachment from the end of one note to the beginning of the next note, where detachment refers to the gap or amount of silence between the end of one note and the beginning the next note, and is also used to select an appropriate transition segment. Pitch and loudness are also used to select segments, but a segment may be adjusted a great deal in pitch (by reading it out at a different rate) or loudness (by applying a gain factor).

Splice/Modify parameters 134 include real time or delay, pitch, and vibrato intensity. "Real time or delay" is used by Modify/Splice block 126 to select the best time for splicing, since the time of transition is known in advance. Vibrato intensity is used to apply a vibrato envelope.

Figure 5:
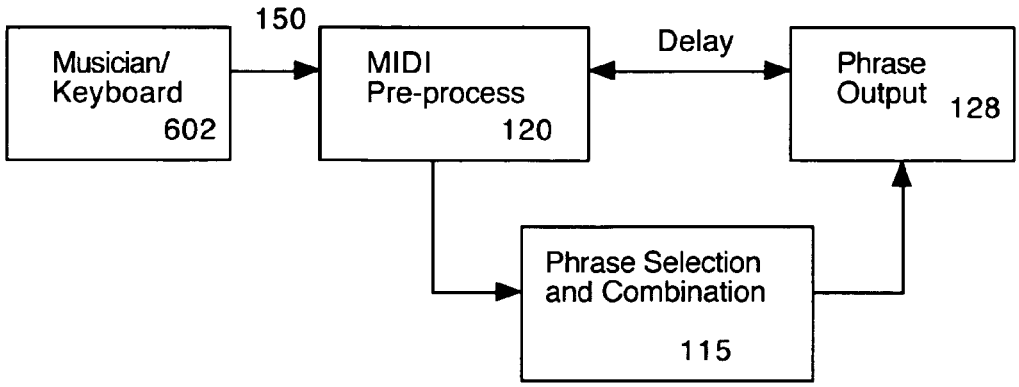
FIG. 5 is a block diagram illustrating a first embodiment of the present invention, wherein the MIDI input stream is generated in real time by a musician and the synthesizer inserts a delay to generate note transitions.

FIG. 5 is a block diagram illustrating a first embodiment of the present invention, wherein the MIDI control stream 150 is generated "live" by a musician 602 (for example with a keyboard) and the synthesizer 108 of FIG. 1 inserts an actual delay to generate note transitions. A small delay in the range 10-40 milliseconds between receipt of MIDI stream 150 and the output of sound data 128 derived from sounds segments is necessary to allow the note transitions to begin before the changeover point.

Figure 6:
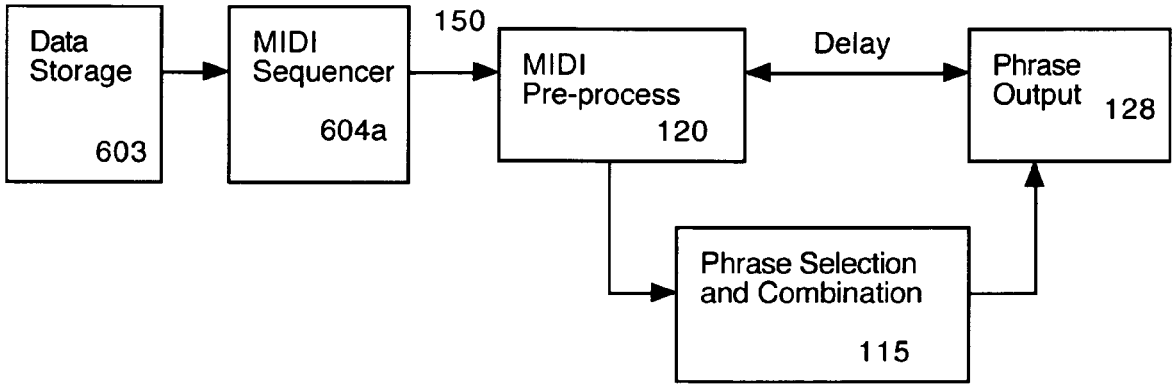
FIG. 6 is a block diagram illustrating a second embodiment of the present invention, wherein the MIDI input stream is generated from stored data by a MIDI sequencer and the synthesizer inserts a delay to generate note transitions.

FIG. 6 is a block diagram illustrating a second embodiment of the present invention, wherein the MIDI control stream 150 is generated from stored data 603 by a MIDI sequencer 604*a*. After the synthesizer 108 of FIG. 1 receives the control stream, it waits an actual delay time, in order to allow time to generate note transitions. The range of this delay time is longer than the previous embodiment, ranging from a fraction of a second to several seconds. This longer delay is permitted because there is no "live" performer requiring immediate audio feedback. The longer delay permits a longer and better anticipation of the changeover point. The stored data 603 might reside in a data file or computer memory. This embodiment is very similar to that of FIG. 5, except for the source of MIDI stream 150 and the length of the delay.

Figure 7:
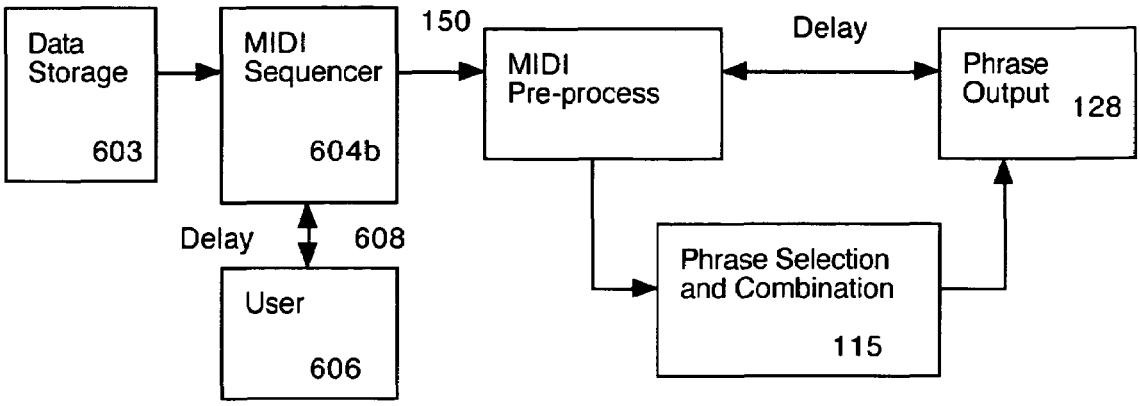
FIG. 7 is a block diagram illustrating a third embodiment of the present invention, wherein the MIDI input stream is generated from stored data by a MIDI sequencer, and wherein the sequencer further provides data relating to upcoming note changeovers to allow the synthesizer to use a functional delay to generate note transitions.

FIG. 7 is a block diagram illustrating a third embodiment of the present invention, wherein the MIDI input stream 150 is generated from stored data 603 by a MIDI sequencer 604*b*. This embodiment is very similar to that of FIG. 6. However, to improve the experience for a user 606, the sequencer sends the MIDI control stream data to the synthesizer a "functional" delay in advance of its internal time clock. The synthesizer then delays the audio output by this functional delay as in the previous embodiment. The resulting final audio output is then synchronized with the sequencer's internal clock. The difference for the user with respect to the previous embodiment is that when interacting with the sequencer—e.g. viewing and editing sequences on a computer screen, listening to playback of sequences, etc—the user does not perceive any delay. The delay is hidden by the internal action of the sequencer in delivering the stored sequence to the synthesizer ahead of time. In another equivalent embodiment, the sequencer 604*b* send control data to the synthesizer ahead of it's internal time-clock. The control data is tagged with a "time-tag" that tells the synthesizer when it should output the sound corresponding to the input control data. These time-tags will be a delay time in the future relative to the time the synthesizer received the control data. The sequencer output display information to the user is synchronized with these time-tags so that the visual display information coincides in time with the sound output of the synthesizer while the synthesizer, receiving the control data in advance, has time to anticipate the note transitions.

Figure 8:
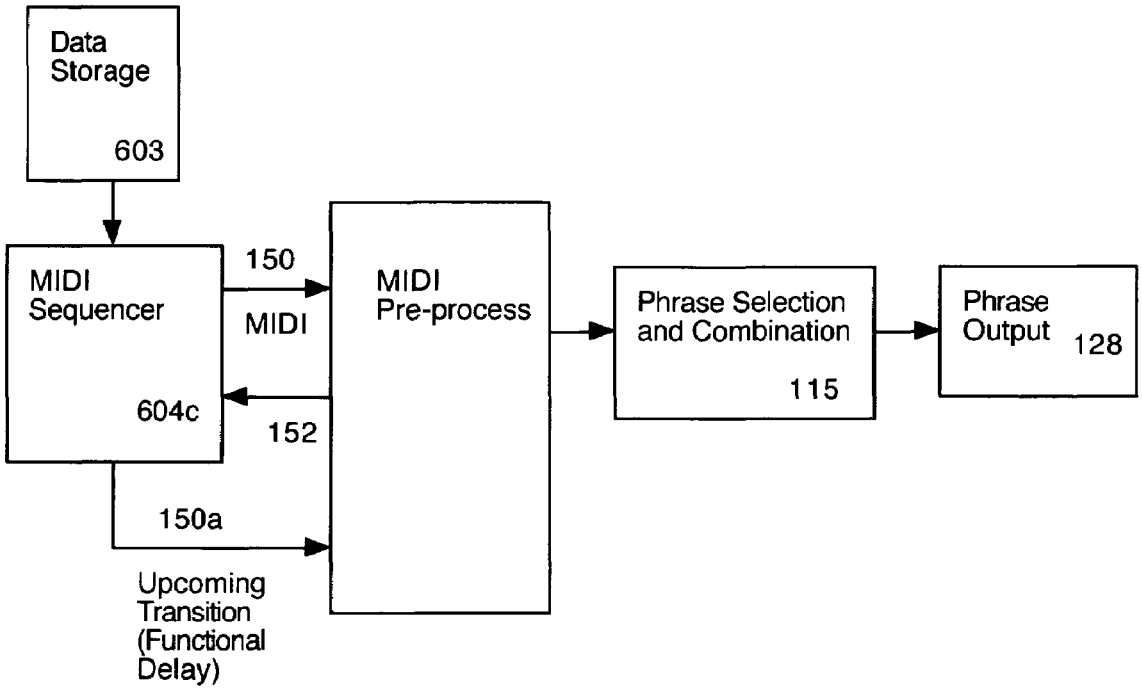
FIG. 8 is a block diagram illustrating a fourth embodiment of the present invention, wherein the sequencer responds to requests by the synthesizer to provide data relating to upcoming note changeovers.

FIG. 8 is a block diagram illustrating a fourth embodiment of the present invention, wherein the MIDI input stream 150 is generated from stored data 603 by a MIDI sequencer 604*c* in the traditional manner, and wherein the sequencer 604*c* further responds to requests 152 by the synthesizer to provide data 150*a* relating to upcoming note changeovers to allow the synthesizer 108 of FIG. 1 to use a delay to generate note transitions. This is called the "query ahead" approach, because the synthesizer queries the MIDI sequencer for information about the stored sequence ahead of when the synthesizer needs to generate sound output for that sequence. Either MIDI sequencer 604*c* could flag upcoming transitions, or MIDI sequencer 604*c* could allow synthesizer 108 of FIG. 1 to examine the sequence as it is generated (before it is output) so that synthesizer 108 of FIG. 1 can determine when transitions will occur, or the sequencer can respond to function calls requesting specific information about the future of the sequence—e.g. what is the pitch, time, and duration of the next note in the sequence.

Figure 9:
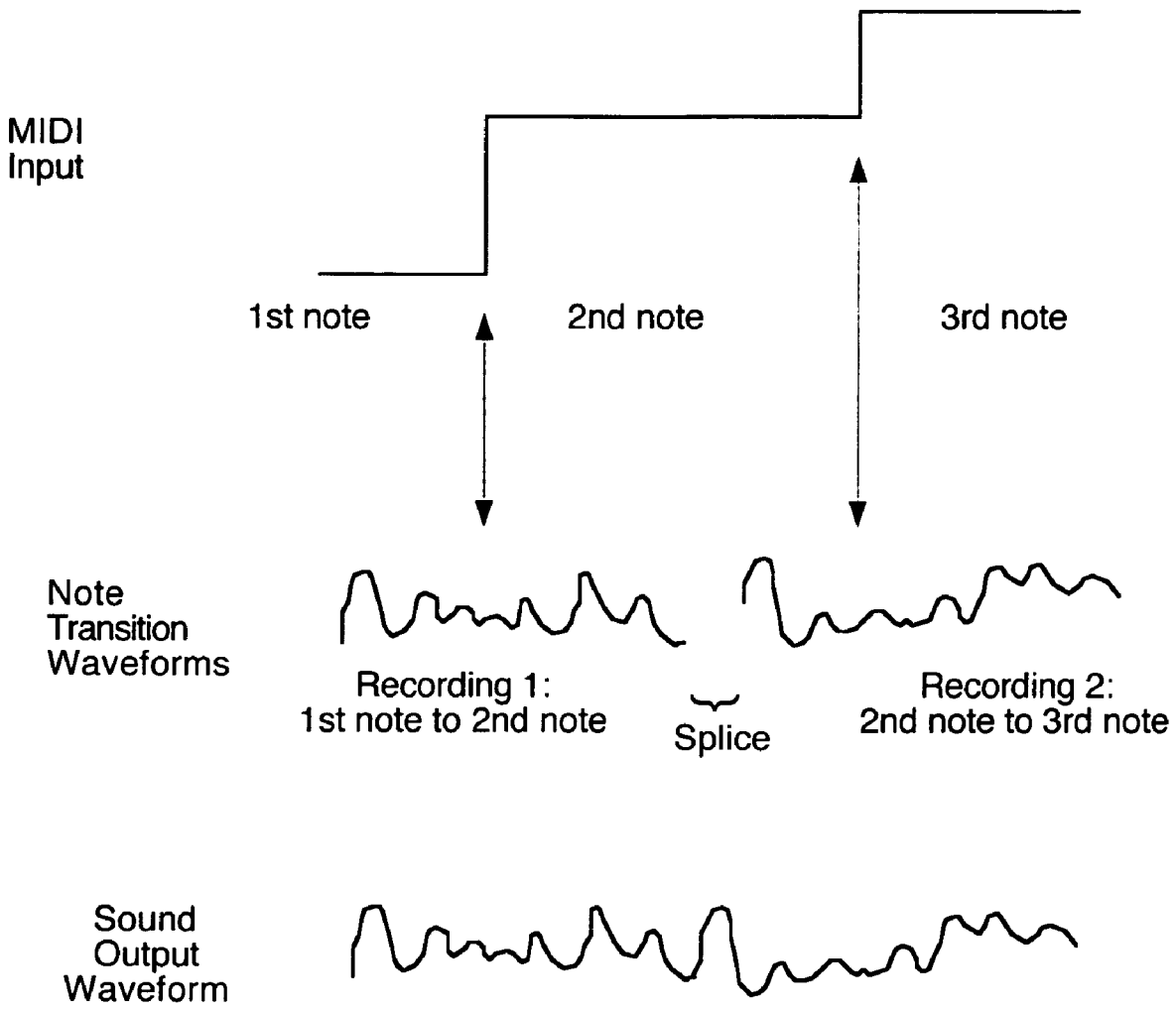
FIG. 9 shows timing diagrams illustrating a fifth embodiment of the present invention, wherein stored note transition waveforms are spliced to form an output sound waveform.

FIG. 9 shows timing diagrams illustrating a fifth embodiment of the present invention, wherein stored note transition waveforms are spliced to form an output sound waveform. Note transition waveforms are recordings of transitions, such as slurs, that are stored as time domain sampled audio data. U.S. Pat. No. 6,316,710 to Lindemann describes one note transition system in detail. These note transitions correspond to the ending of a first note, followed by a transitions period, followed by the beginning of the next note. This particular embodiment does not include separate recordings of note sustains, though alternative embodiments could include those as well. Any of the first four embodiments (shown in FIGS. 5-8) could be used to provide information including start time, pitch, and intensity of the second note during the sustain of the first note. Due to the delay of the present invention, this information is provided sufficiently in advance of the start of the third note so that the splice to the transition recording including an ending period of the second note occurs.

Figure 10:
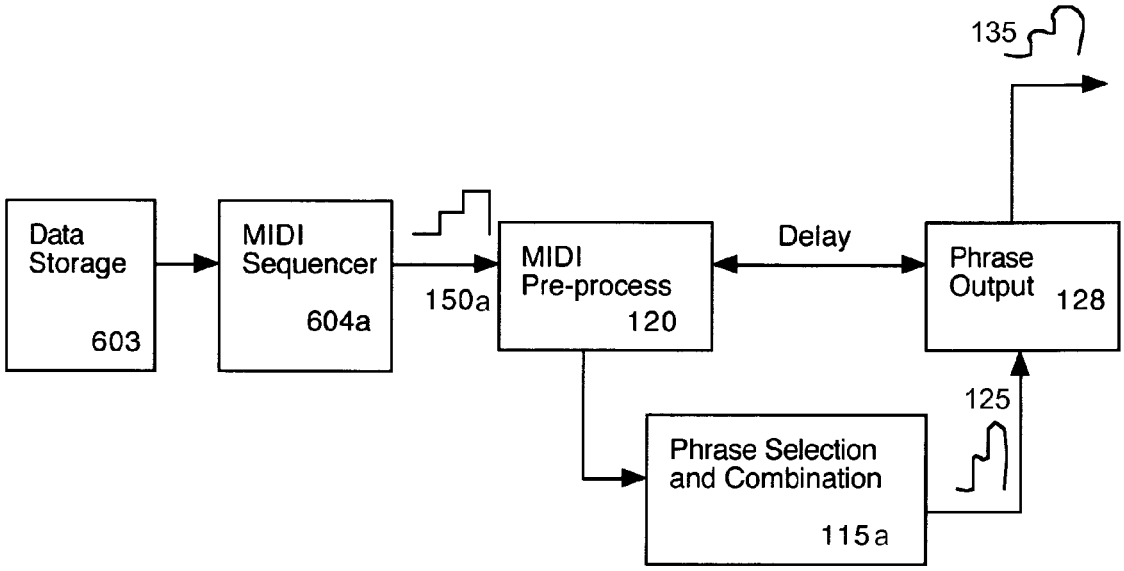
FIG. 10 shows a block diagram illustrating a sixth embodiment of the present invention, wherein the delay is utilized to review the control data associated with several upcoming notes and to locate and retrieve a recording approximating those several notes.

FIG. 10 shows a block diagram illustrating a sixth embodiment of the present invention, wherein the delay is utilized to review the control data associated with several upcoming notes 150*a*, and to locate and retrieve a recording 125 approximating those several notes from Phrase Selection and Combination block 115*a*. Phrase Output block 128 adjusts the recording 125 (for example by modifying pitch and duration) and outputs the more expressive version 135 of the several notes 150*a*.

The embodiment shown in FIG. 10 is based upon FIG. 6, wherein the sequencer 604*a* provides the note control data to the synthesizer, and the synthesizer inserts an actual period of delay. However, those skilled in the art of sound synthesis will appreciate that any of the first four embodiments may be similarly used to retrieve recordings representing several notes as well as single notes and transitions.

Figure 11:
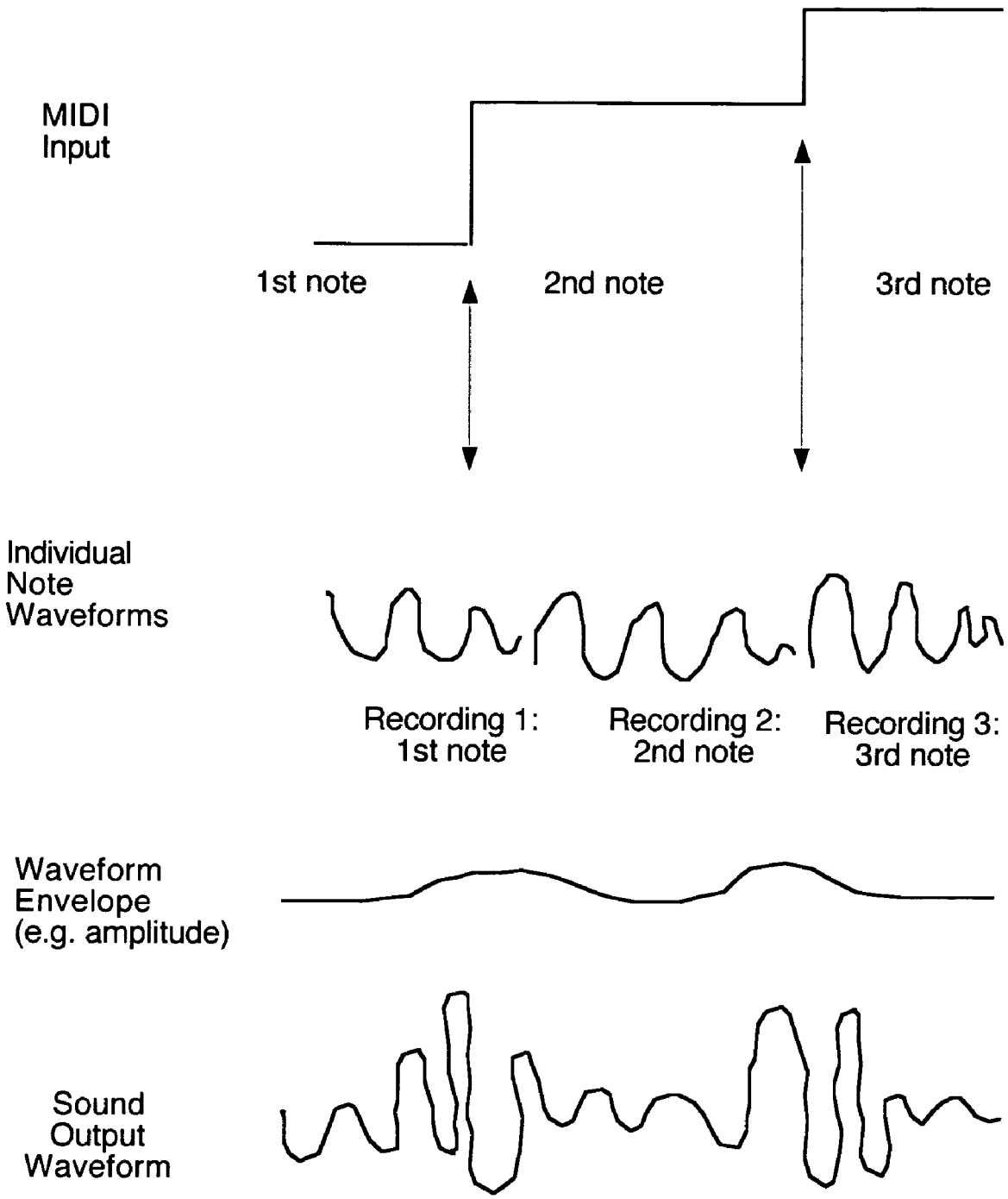
FIG. 11 shows timing diagrams illustrating a seventh embodiment of the present invention, wherein stored individual note waveforms are modified by a waveform envelope to form an output sound waveform.

FIG. 11 shows timing diagrams illustrating a seventh embodiment of the present invention, wherein stored individual note waveforms are modified by a waveform envelope to form an output sound waveform. In most traditional sampling synthesizers, note transitions are not stored. Instead, individual note waveform recordings are stored. Some of the effect of a realistic note transition is accomplished by applying a waveform envelope to the changeover period, starting before the first note waveform ends. Waveform envelopes are time varying control envelopes, such as amplitude envelopes, dynamic filter envelopes that change the timbre of the recordings, and pitch envelopes. These time-varying envelopes may take the form of continuous MIDI controllers or may be in some other format.

Again, any of the first four embodiments (shown in FIGS. 5-8) could be used to provide information including start time, pitch, and intensity of the third note during the sustain of the second note, via the delay so that the transition waveform envelopes can begin prior to the third note.

Figure 12:
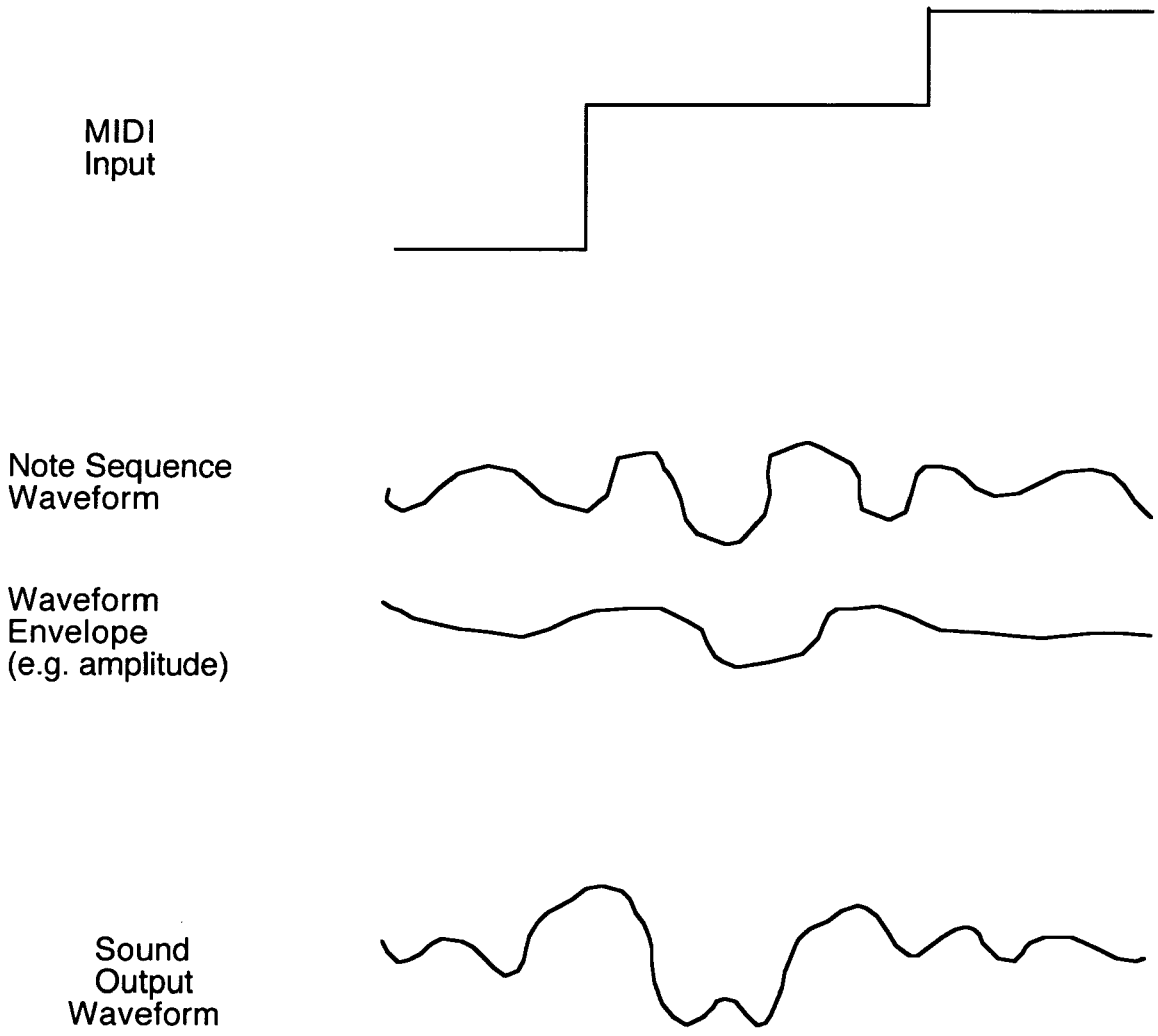
FIG. 12 shows timing diagrams illustrating an eighth embodiment of the present invention, wherein a series of notes is modified by an envelope.

FIG. 12 shows timing diagrams illustrating an eighth embodiment of the present invention, wherein a series of notes is modified by an envelope. Any of the first four embodiments may be used to generate the note sequence waveform, which represents a series of notes. A waveform envelope (such as an amplitude envelope) is applied to the note sequence waveform to improve the expression of the series of notes.

Figure 13:
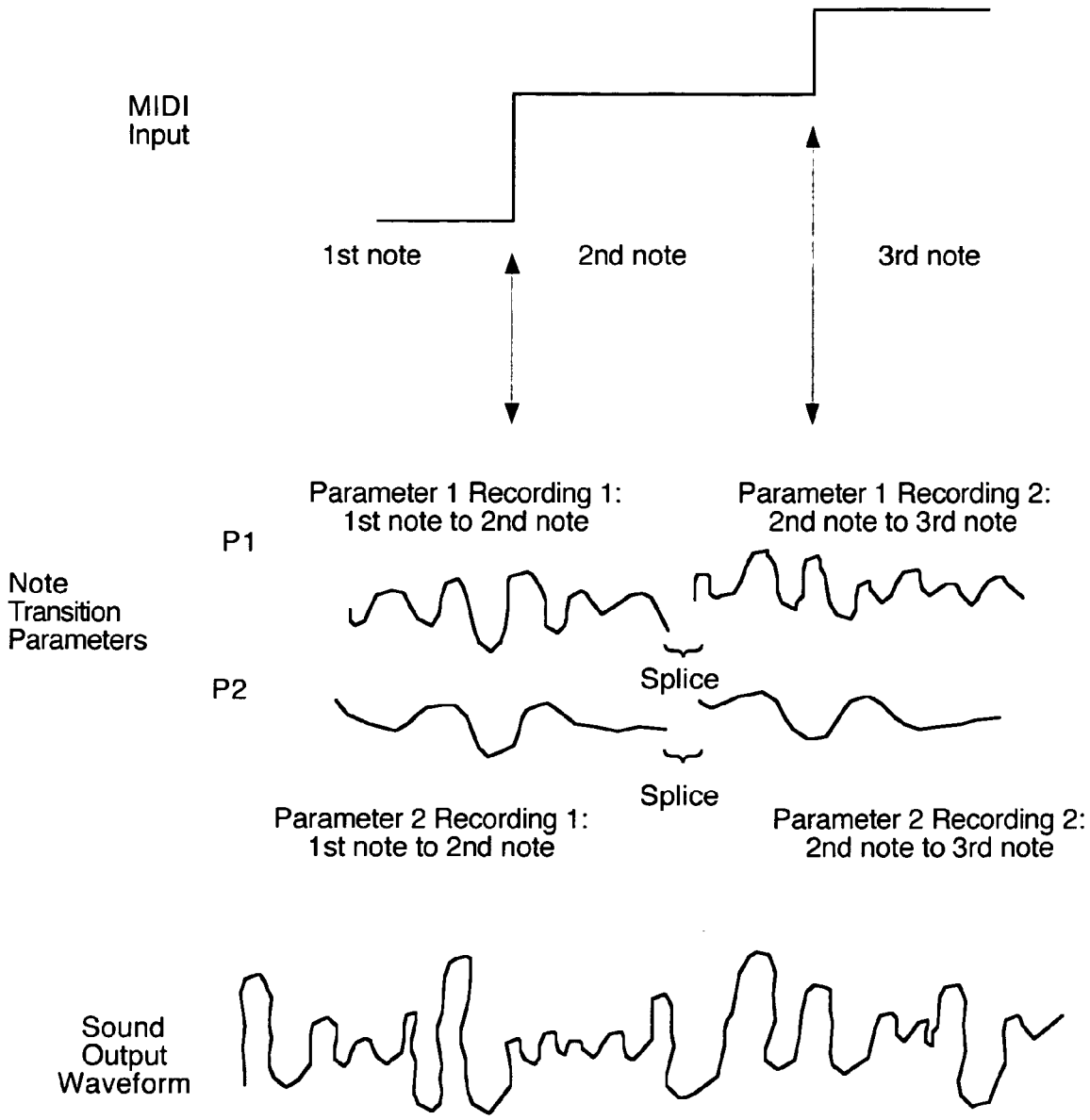
FIG. 13 shows timing diagrams illustrating a ninth embodiment of the present invention, wherein stored note transition parameters are spliced to form an output sound waveform.

FIG. 13 shows timing diagrams illustrating a ninth embodiment of the present invention, wherein stored note transition parameters are spliced to form an output sound waveform. A variety of parametric synthesis schemes are known in the art. For example, additive synthesis is a type of parametric synthesis in which sounds are represented in terms of a set of time-varying parameters. Rather than storing time domain waveforms corresponding to note recordings, time-varying additive synthesis parameters are stored instead. Examples of this sort of system are described in U.S. Pat. Nos. 6,111,183 and 6,298,322, both to Lindemann. These patents teach techniques for storing and synthesizing sounds in terms of time-varying amplitude and pitch parameters of sinusoidal sound components or harmonics. Additional parametric techniques include LPC, AR, ARMA, Fourier techniques, FM synthesis and other related techniques known in the art of sound synthesis. All of these techniques depend on a collection of time-varying parameters to represent sound waveforms rather than time-domain waveforms as used in traditional sampling synthesis. Generally there will be a multitude of parameters—e.g. 10-30 parameters—to represent a short 5-20 millisecond sound segment. Each of these parameters will then typically be updated at a rate of 50-200 times a second to generate the dynamic time-varying aspects of the sound. These time-varying parameters are passed to the synthesizer—e.g. additive harmonic synthesizer, LPC synthesizer, FM synthesizer. etc—where they are converted to an output sound wave waveform.

The embodiment of FIG. 13 illustrates a system in which note transition parameters are stored. This is a sequence of parameter changes across multiple parameters that describes a sound segment from a fraction of a second to several second long that corresponds to the ending part of one note and the beginning of the next. In FIG. 13, when a phrase is to be constructed, the sequence of parameters corresponding to a note transition between the first and second notes is read out, then the sequence of parameters corresponding to a note transition between the second and third note is read out. This second sequence of parameters is spliced to the end of the first sequence using simple concatenation or optionally using a simple cross-fade interpolation between the first transition sequence and the second transition sequence. The resulting spliced sequence of parameters is input to the synthesizer for conversion to a time-domain audio waveform output.

Figure 14:
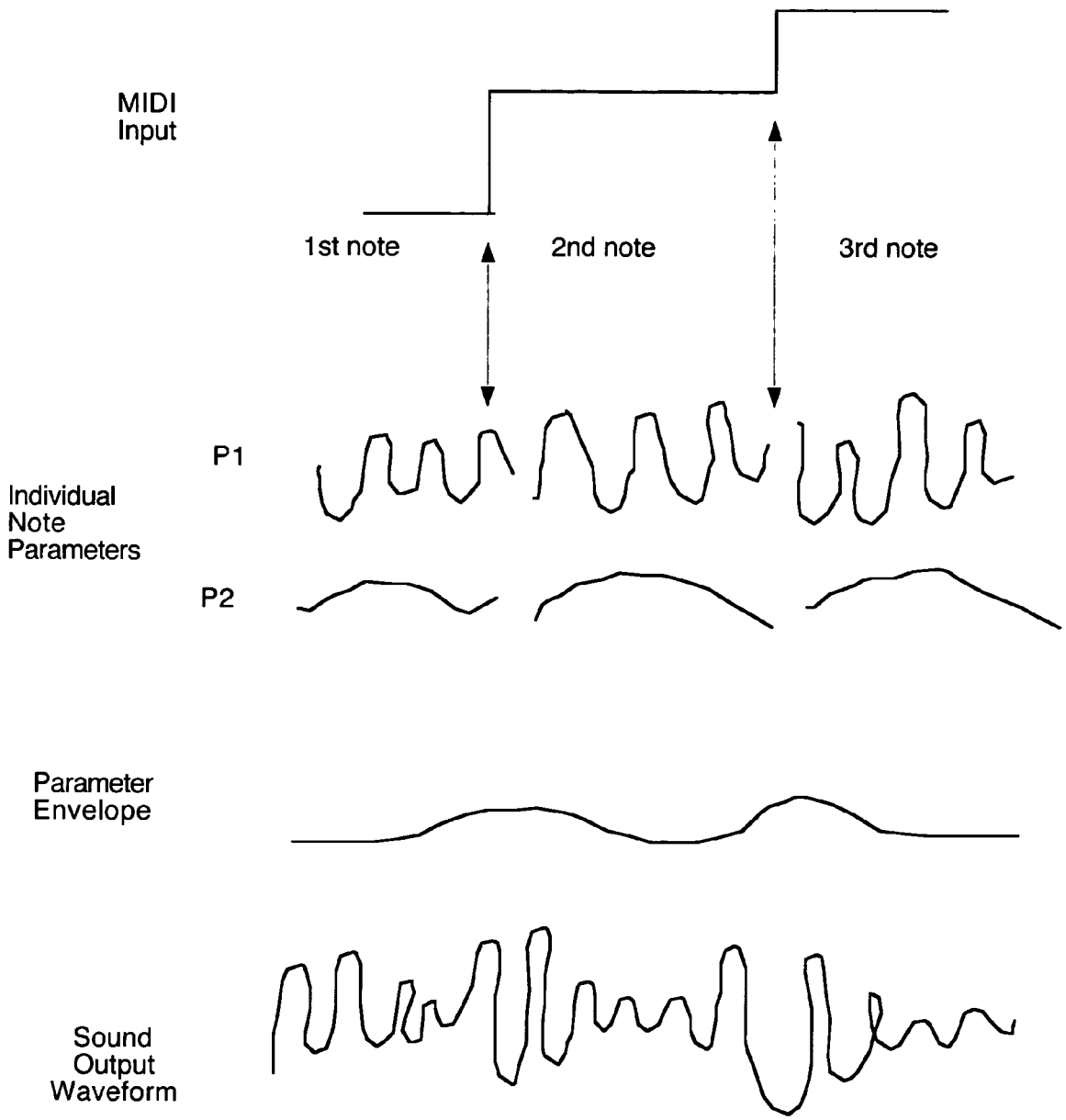
FIG. 14 shows timing diagrams illustrating an tenth embodiment of the present invention, wherein stored individual note parameters are modified by a parameter envelope to form an output sound waveform.

FIG. 14 shows timing diagrams illustrating a tenth embodiment of the present invention, wherein stored individual note parameters are modified by a parameter envelope to form an output sound waveform. In this case the stored parameter sequences correspond to individual notes rather than note transitions. One or more parameter envelopes are used to modify these parameter sequences near a note transition point. For example the Parameter Envelope shown in FIG. 14 is multiplied with Parameter 1 of note 1 prior to the end of note 1 and is multiplied with Parameter 1 of note 2 at the beginning of note 2. The resulting modified individual note parameter sequences are spliced using the same techniques described in the previous embodiment to generate a spliced and modified parameter sequence that is input to the synthesizer for conversion to a time-domain output waveform.

For the ninth and tenth embodiments described above, any of the first four embodiments (shown in FIGS. 5-8) could be used to provide information including start time, pitch, and intensity of the second note during the sustain of the first note. Due to the delay of the present invention, this information is provided sufficiently in advance of the start of a note so that the spliced transition sequences in the ninth embodiment or the generation of Parameter Envelopes in the tenth embodiment can occur ahead of the note changeover time.

What is claimed is:

1. The method of synthesizing sound comprising the steps of:

(a) receiving a sequence of control signal inputs for specifying aspects of a series of notes to be generated and output, wherein note-A occurs earlier in the series than note-B;

(b) inserting a delay between receiving the control signals relating to a given note and generating the given note;

(c) generating notes using a synthesizer based upon the control signals; and (d) outputting generated notes; wherein (e) during the delay, the steps performed including (e)(1) examining control signals relating to note-B, and, (e)(2) modifying the loudness shape of a transition between note-A and a note following note-A including modifying the loudness shape of the end of note-A based upon control signals relating to note-B.

2. The method according to claim 1 further including the step of generating the control signals live from a real-time controller, and wherein said delay is on the order of 3 to 100 milliseconds.

3. The method of claim 2 wherein said controller is a MIDI controller.

4. The method of claim 2 wherein said controller is a MIDI keyboard controller.

5. The method according to claim 1, further including the steps of storing the control signals in a data file and loading the control signals from the data file into the synthesizer.

6. The method according to claim 1 further including the steps of storing the sequence of control signals and outputting the stored control signals from a sequencer to the synthesizer.

7. The method according to claim 6 wherein the step of outputting the stored control signals from a sequencer outputs an entire sequence of control signals corresponding to a section of music to the synthesizer before the synthesizer begins generating notes based upon the control signals.

8. The method according to claim 6 further including the step of the synthesizer querying the sequencer for information about the stored sequence of control signals before the synthesizer generates notes based upon the control signals.

9. The method according to claim 6 further including the step of the synthesizer querying the sequencer for information regarding the entire stored sequence of control signals before the synthesizer generates notes based upon the control signals.

10. The method according to claim 1 further including the step of splicing a note transition waveform into the series, wherein said note transition waveform corresponds to the end of a note being currently played, a transition period, and the beginning of the next note in the series.

11. The method according to claim 1 wherein a succession of control signals within the sequence describe several notes to be generated and further including the step of splicing a single recording of several connected notes into the series in the place of the several notes.

12. The method according to claim 1 further including the step of applying a time-varying envelope to the end of a note being currently played.

13. The method according to claim 1 further including the step of splicing between time-varying parameters of a parametric synthesizer, wherein said time-varying parameters represent a note transition that corresponds to the end of a note being currently played, a transition period, and the beginning of the next note.

14. The method according to claim 1 wherein a succession of control signals within the sequence describe several notes to be generated, and further including the step of splicing between time-varying parameters of a parametric synthesizer, wherein said time-varying parameters represent a sequence of several notes, and wherein said time-varying parameters are modified to form the synthesized output corresponding to the next several notes to be generated.

15. The method according to claim 1 wherein the step of generating notes is accomplished using a parametric synthesizer, and further including the step of altering the parameters corresponding to a note being currently played in preparation for the next note in the series.

16. Apparatus for synthesizing sound comprising:

means for providing a sequence of control signal inputs for specifying aspects of a series of notes to be generated and output, wherein note-A occurs earlier in the series than note-B;

a synthesizer for receiving the control signals and generating notes based upon the control signals;

means for inserting a delay between the synthesizer receiving control signals relating to a given note and the synthesizer generating the given note;

means within the synthesizer for examining control signals relating to note-B and modifying, the loudness shape of a transition between note-A and a note following note-A including modifying the loudness shape of the end of note-A based upon control signals relating to note-B during the delay; and means for outputting generated notes.

17. The apparatus of claim 16 wherein the means for providing a sequence comprises a sequencer.

18. The apparatus of claim 16 wherein the means for providing a sequence comprises a MIDI controller.

* * * * *